United States Patent [19]

Kohanawa

[11] Patent Number: 4,935,589

[45] Date of Patent: Jun. 19, 1990

[54] ARC EXTINCTION CHAMBER UNIT IN A MULTIPOLAR CIRCUIT BREAKER

[75] Inventor: Akihiko Kohanawa, Kanagawa, Japan

[73] Assignee: Fuji Electric Co., Ltd., Kanagawa, Japan

[21] Appl. No.: 270,329

[22] Filed: Nov. 14, 1988

[30] Foreign Application Priority Data

Dec. 12, 1987 [JP] Japan ..... 62-314829
Apr. 11, 1988 [JP] Japan ..... 63-88583

[51] Int. Cl.[5] ..... H01H 33/08
[52] U.S. Cl. ..... 200/144 R
[58] Field of Search ..... 200/144 R, 148 C; 335/16, 201

[56] References Cited

U.S. PATENT DOCUMENTS 2,648,742 8/1953 Edmunds ..... 200/144
4,596,909 6/1986 Kakizoe et al. ..... 200/144 R
4,845,460 7/1989 Manthe et al. ..... 200/144 R

FOREIGN PATENT DOCUMENTS 1174401 7/1964 Fed. Rep. of Germany .
1908751 11/1970 Fed. Rep. of Germany .
7327820 7/1973 Fed. Rep. of Germany .
2949012 6/1981 Fed. Rep. of Germany .

*Primary Examiner*—Robert S. Macon
*Attorney, Agent, or Firm*—Finnegan, Henderson, Farabow, Garrett and Dunner

[57] ABSTRACT

There is disclosed an arc extinction chamber unit for assembly into a multipolar circuit breaker. This chamber unit is composed of arc extinction chambers provided one for each pole, and coupling arms for connecting the chambers to each other. The chambers and coupling arms are molded into one unitary body. Each chamber can contain a generated arc gas pressure, preventing the arc gas pressure being vented to the outer box of the circuit breaker, thereby reducing the stress on the outer box. The arc extinction chamber unit includes restraining arms which connect to the walls of the circuit breaker outer box, further strengthening the box. Each arc extinction chamber contains grooves in the inner wall for easy insertion of grids. The grids are configured with V-shaped indentations. The integral construction of the chamber units and coupling arms provides for assembly into the circuit breaker in a single assembly step.

5 Claims, 8 Drawing Sheets

ARC EXTINCTION CHAMBER UNIT IN A MULTIPOLAR CIRCUIT BREAKER

BACKGROUND OF THE INVENTION

1. Field of the Invention:

The present invention relates to an arc extinction chamber unit in a multipolar circuit breaker.

2. Description of the Prior Art:

Prior art arc extinction chamber units are depicted in FIG. 13 and FIG. 14. An arc extinction chamber unit 100 illustrated in FIG. 13 is designed with grids 101, each formed with a V-shaped groove, sandwiched in between insulator side plates 102. The arrangement of the arc extinction chamber unit shown in FIG. 14 differs in that grids 201, each formed with a U-shaped groove, are held by insulator plates 202 which are bent in a U-shape. The grids 101 and 201, in FIGS. 13 and 14 respectively, are fixed by inserting projections 103 and 203 provided at both ends thereof into substantially rectangular slits formed in the insulator plates 102 and 202, and by caulking them in place.

FIG. 15 illustrates an example of a conventional circuit breaker 300 equipped with a prior art arc extinction chamber unit.

In FIG. 15, an outer insulator box 301 accomodates a circuit breaker mechanism consisting of a movable contact 302, a fixed contact 303, an opening/closing mechanism 304, an operation handle 305 and a tripping device 306. The arc extinction chamber unit 100 is disposed in an area of the breaker mechanism swept out by the movable contact 302.

The circuit breaker 300 breaks an accidental overcurrent, whereby the movable contact 302 is separated from the fixed contact 303. At this time, an electric arc generated between the contacts is attracted to the grids 101 of the arc extinction chamber unit 100 by an electromagnetic force. The generated arc is cut off by the grids 101 and at the same time cooled, thereby extinguishing the arc. The breaking process is thus completed without arc damage to contacts 302 and 303.

In the prior art, the insulator plates 102 which hold the grids 101 serve to evolve a gas for furthering the arc extinction due to thermal decomposition when being exposed to an intense heat of the electric arc, thus accelerating the cool-down of the arc. The gas is instantaneously generated, and hence an instantaneous pressure is exerted on the inner walls of the outer box 301 of the circuit breaker 300. In general, it is a common practice that the gas is then vented to prevent the outer box 301 from being ruptured by over-pressure.

There are, however, the following defects inherent in the prior art arc extinction chamber unit.

(1) When installed in the multipolar circuit breaker, it is necessary to incorporate an arc extinction chamber unit for every pole. This incorporation requires excessive labour. Further, because the grids are sandwiched in between the relatively-easy-to-deform insulator plates, very careful installation is needed, further slowing the assembly process. When the assembly is performed by using an automatic apparatus such as a robot, the arc extinction chamber unit can be easily damaged.

(2) The construction of the arc extinction chamber comprises a combination of grids and insulator plates, resulting in several openings and vents. It is therefore impossible for the arc extinction chamber unit to contain the pressure of the gas instantaneously evolved due to the electric arc. The gas pressure is vented directly to the outer box of the circuit breaker. Hence, the outer box is required to have a strength sufficient to endure the gas pressure. As a breaking capacity of the circuit breaker increases, the energy necessary for the breaking process augments. This results in an increment in the amount of generated gas, and the strength of the outer box must withstand this additional pressure. For this reason, the outer box must be built very thick, with the result that the box becomes physically large. Further, more material is required for construction of the box. The result of this is that the physical structure of the circuit breaker box may limit the breaking capacity of the circuit breaker.

(3) After a plurality of grids have been interposed between the insulator plates, it is necessary to caulk them in place. This process is complicated and increases the number of required assembly steps. The process is therefore unsuitable for mass production.

(4) Since the insulator plates are exposed to the intense heat associated with the electric arc, the insulator plates become burnt and damaged. This results in the grids falling away from the insulator plates. In order to prevent this degradation, a reinforcement is required. For example, a heat-resistant adhesive-backed tape can be applied over the caulked sections. This step however increases the overall cost.

SUMMARY OF THE INVENTION

It is a primary object of the present invention to provide an arc extinction chamber unit for use in a multipolar circuit breaker, which will correct the disadvantages inherent in the prior art.

It is an object to provide an arc extinction chamber unit based on a multipolar integral construction which can be easily incorporated into a circuit breaker.

A further object is to provide an extinction arc chamber unit will be capable of containing the gas pressure evolved when the breaking is performed rather than venting it to the outer box of the circuit breaker.

A further object is to provide an arc extinction chamber unit wherein the grids can be easily inserted therein.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, according to one aspect of the invention, in a multipolar circuit breaker including an outer insulator box which accomodates a multipolar circuit breaker mechanism, there is provided an arc extinction chamber unit comprising: an arc extinction chamber provided for each pole of the multipolar breaker, and coupling arms for connecting each of the arc extinction chambers to the others, the coupling arms being molded into one united body with the arc extinction chamber unit.

The arc extinction chamber unit according to the present invention comprises an integral molding construction, and it is therefore feasible to incorporate the unit into a multipolar circuit breaker in a single assembly step.

By virtue of advantages in maleability of the molding, the arc extinction chamber can be formed in a box-like configuration having extremely small openings. This box-like configuration enables the arc extinction chamber to contain the instantaneous pressure of the arc gas evolved during the breaking process, thereby preventing the pressure from acting against the outer box. The load on the outer box is therefore diminished. In the present invention, both ends of the arc extinction chamber unit are provided with restraining members connected to the side walls of the outer box by a fastener arrangement. The restraining members prevent the outer box from being expanded outwardly by the gas pressure. Therefore the arc extinction chamber unit further serves to reinforce the strength of the outer box. Moreover, the box-like shape of the arc extinction chamber includes grooves into which grids can readily be inserted. The grids can be mounted on the insulator walls of each arc extinction chamber simply by fitting the grids therein. Thus, the grids are firmly held.

Further, the deionization effects of the arc can be improved by both properly selecting the resinous molding materials to construct the arc extinction chamber and properly designing the shape of the inner walls and grids. The inner wall surface of the arc extinction chamber is formed to assume a substantially V-shape in cross section, whereby the electric arc tends to extend towards the grids and is held in this state. This permits a large amount of deionizing gas to be evolved from the wall surfaces. At this time, the resinous molding material has to generate a light weight gas by thermal decomposition having high deionization effects such as $H_2$.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DETAILED DESCRIPTION OF THE PREFERRED EMBODIMENTS

The embodiments of the present invention will hereinafter be described with reference to the accompanying drawings.

Figure 1:
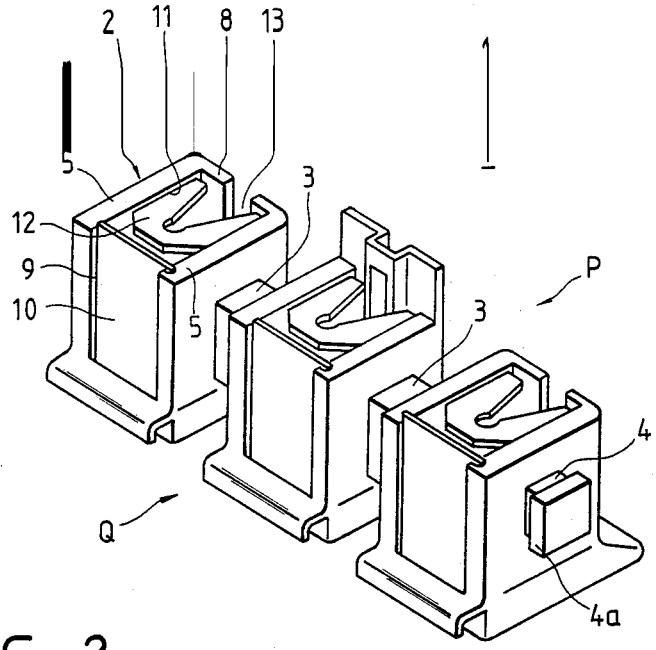
FIG. 1 is a perspective view illustrating the inside of an arc extinction chamber unit with its upper wall removed in an embodiment of the present invention.
Figure 2:
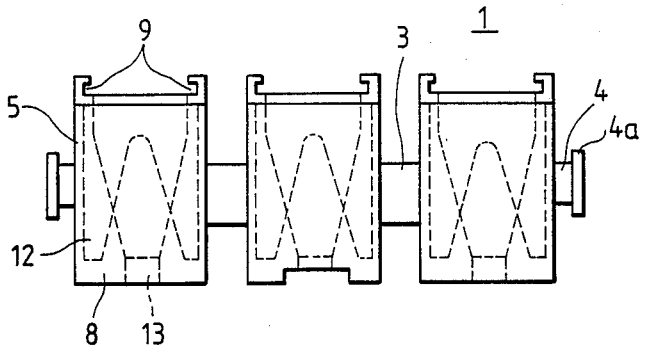
FIG. 2 is a plan view of FIG. 1.
Figure 3:
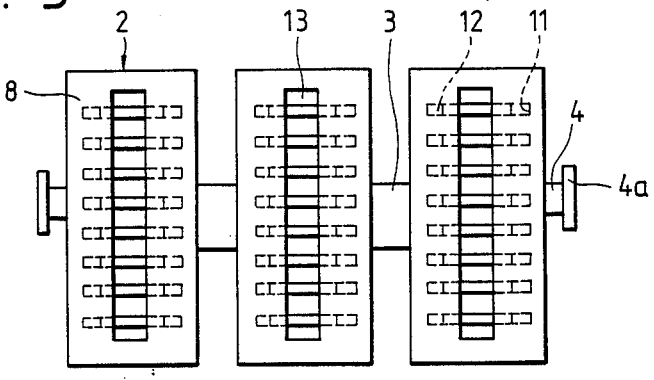
FIG. 3 is a front elevation taken in the direction P depicted in FIG. 1.
Figure 4:
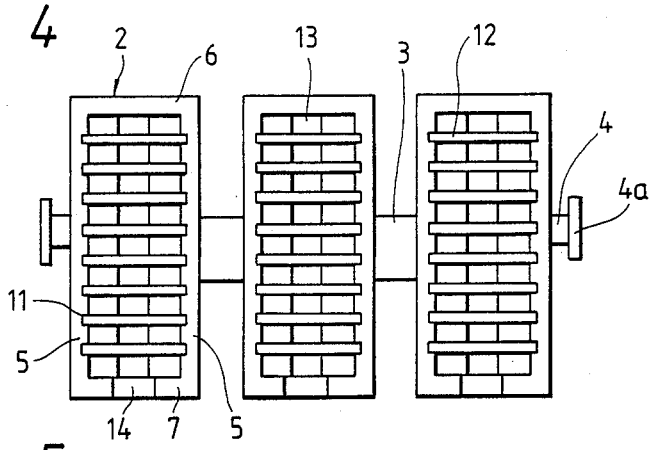
FIG. 4 is a rear elevation taken in the direction Q depicted in FIG. 1.

FIGS. 1 to 4 in combination show a first embodiment of the present invention. FIG. 1 is a perspective view illustrating the inside of an arc extinction chamber unit with its upper wall removed. FIG. 2 is a plan view. FIG. 3 is a front elevation taken in the direction P depicted in FIG. 1. FIG. 4 is a rear elevation taken in the direction Q depicted in FIG. 1.

In this embodiment, an arc extinction chamber unit generally designated as 1 is composed of arc extinction chambers 2 provided for three poles (three phases) and coupling arms 3, assuming a square in section, for connecting these three arc extinction chambers 2 to each other. These components as a whole are molded into one united body. Both ends of the arc extinction chamber unit 1 are provided integrally with restraining members 4 which engage with side walls of an outer box of a circuit breaker.

The arc extinction chamber 2 assuming a box-like configuration (FIG. 4) consists of side walls 5, an upper wall 6, a bottom wall 7 and a front wall 8. Only a rear surface (opposite to the front wall 8) of this chamber 2 is formed open. The rear surface can, however, be blocked by a shielding plate 10 (FIG. 1) inserted along grooves 9 located opposite to each other in rear end portions of the side walls 5.

The inner surfaces of the side walls 5 are formed with grooves 11 in which a plurality of grids are fitted. The grids 12 formed with V-shaped indentations, are fitted in the grooves 11 from the rear surface.

The front wall 8 is formed with a slit 13, extending in a vertical direction, for guiding, as will be explained later, an arm of a movable contact. As illustrated in FIG. 2, a spacing between the side walls 5 is gradually widened from the slit 13 to the rear surface. In other words, a cross-sectional configuration (a shape when the arc extinction chamber is viewed from the upper surface) of the inner wall surfaces of the side walls 5 is substantially a V-shape.

The bottom wall 7, as will be mentioned later, is formed with an opening 14 (FIG. 4) in which a fixed contact of the circuit breaker is fitted.

The restraining members 4 so provided on the side walls of both end portions of the arc extinction chamber 2 include, as will be described later, collar-like engaging pieces **4*a***, each stretching vertically and bilaterally, for engaging the side walls of the outer box of the circuit breaker.

Figure 5:
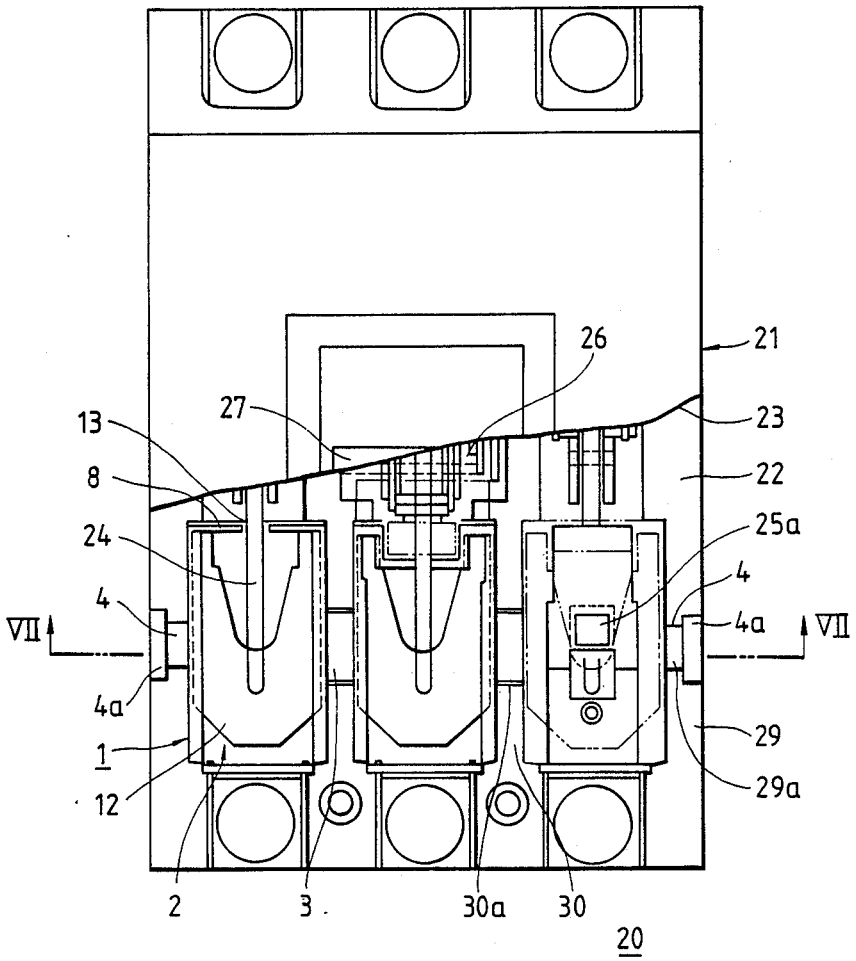
FIG. 5 is a plan view illustrating the inside of a circuit breaker, into which the arc extinction chamber unit of FIG. 1 is incorporated, with a cover partially removed.
Figure 6:
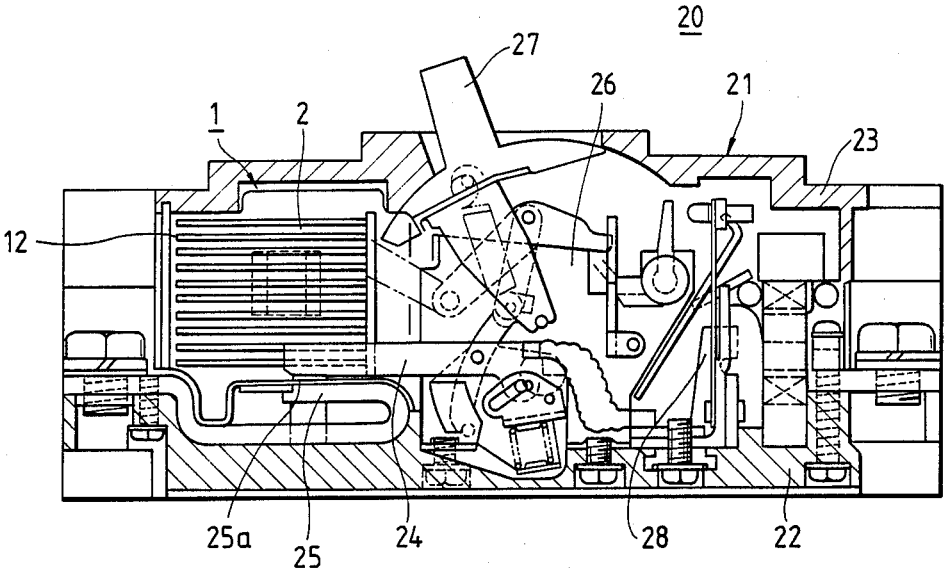
FIG. 6 is a vertical sectional view of FIG. 5.
Figure 7:
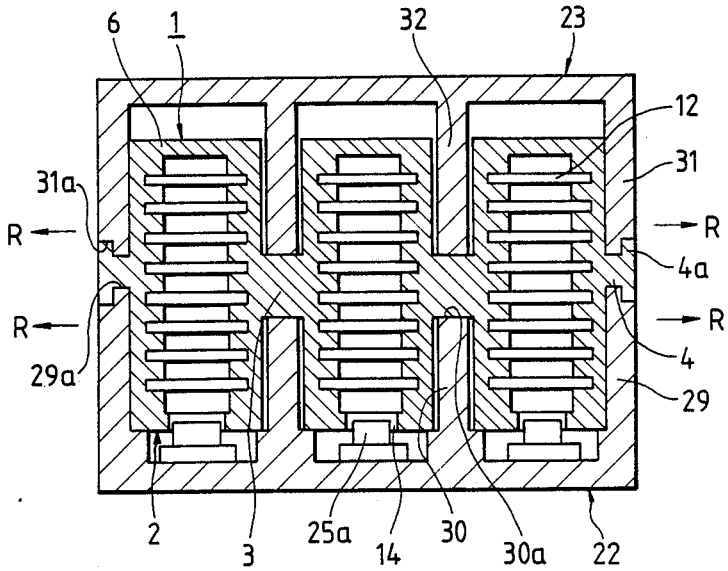
FIG. 7 is a sectional view taken substantially along the line VII—VII of FIG. 5.

Referring next to FIGS. 5 to 7, there is illustrated the arc extinction chamber unit 1 assembled into a circuit breaker 20. FIG. 5 is a plan view illustrating the inside of the arc extinction chamber unit 1, where a cover of the circuit breaker 20 and the upper wall of each arc extinction chamber 2 are removed (the arc extinction chamber disposed at the right end of the Figure is not shown). FIG. 6 is a vertical sectional view of FIG. 5.

FIG. 7 is a sectional view taken substantially along the line VII—VII of FIG. 5.

In FIGS. 5 and 6, the reference numeral 21 denotes an outer box of the circuit breaker 20. The outer box is composed of an upper casing 22 and a cover 23 placed thereon. The outer box 21 encases a breaking mechanism consisting of a movable contact 24, a fixed contact 25, an opening/closing mechanism 26, an operation handle 27 and a tripping device 28. The arc extinction chamber unit 1 is disposed in an area of the breaker mechanism swept out by the movable contact 24.

As depicted in FIG. 7, a notch 29*a* is formed in a side wall 29 of the casing 22, while an interposed partition wall 30 is formed with a notch 30*a*. The arc extinction chamber unit 1 is incorporated by fitting the restraining member 4 and the coupling arm 3 in the notches 29*a* and 30*a*, respectively. The restraining member 4 and the coupling arm 3 abut on a connecting surface between the side wall 31 of the cover 23 and the casing 22 of the interposed partition wall 32, thereby fixedly holding the arc extinction chamber unit 1. The cover 23 is fastened to the casing 22 with screws (not shown).

As depicted in FIG. 5, the movable contact 24 is inserted into the slit 13 of the front wall 8 of the arc extinction chamber so that the movable contact 24 performs its opening/closing operation while being guided along the slit 13. Fitted in the opening 14 formed in the bottom wall 7 is a fixed contact point 25*a* bonded to the fixed contact 25, as shown in FIG. 7.

As shown in FIGS. 5 and 7, the outside portion of the notch 29*a* of the side wall of the casing is formed deeper to adjust to a configuration of the engaging piece 4*a* of the restraining member 4. The contiguous portion of the cover side wall 31 to the restraining member 4 is formed with a notch 31*a* (FIG. 7) adaptive to the engaging piece 4*a*. Based on this arrangement, as shown in FIG. 7, the engaging pieces 4*a* of the restraining members 4 provided at both ends of the arc extinction chamber unit 1 engage with the side walls 29 and 31 of the outer box 21. Restraining member 4 restrains the outer box 21 from being expanded in the direction indicated by an arrow R of FIG. 7 by force of the arc gas pressure. Therefore, in addition to the arc extinguishing function, the arc extinction chamber unit 1 functions to reinforce and strengthen the outer box 21 of the circuit breaker.

With the exception of the rear surface of the arc extinction chamber 2 and a slight opening of the slit 13 the arc extinction chamber is sealed. The pressure of arc gas generated during the breaking process of the circuit breaker 20 is contained in the arc extinction chamber unit 1. Thereafter the arc gas is discharged from the rear surface to the outside of the outer box 21. As a result, the overall gas pressure load on the outer box 21 during the breaking process is substantially reduced. It is to be noted that, as explained earlier, the shielding plate 10 (FIG. 1) may be mounted on the rear surface of the arc extinction chamber from which the arc gas is emitted.

Figure 8:
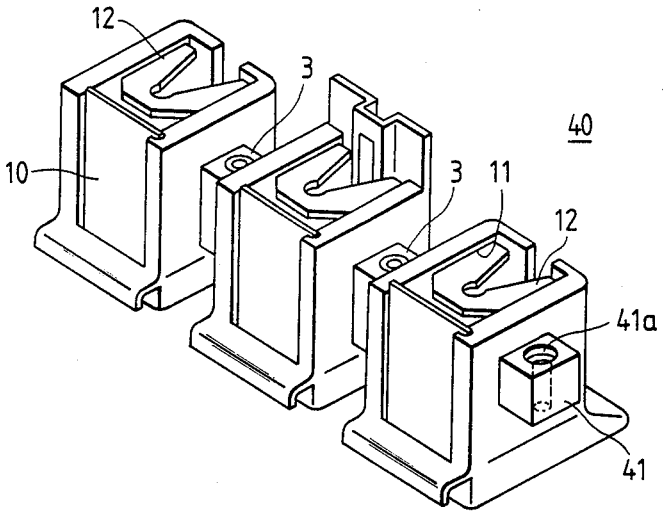
FIG. 8 is a perspective view corresponding to FIG. 1, illustrating a second embodiment of the present invention.
Figure 9:
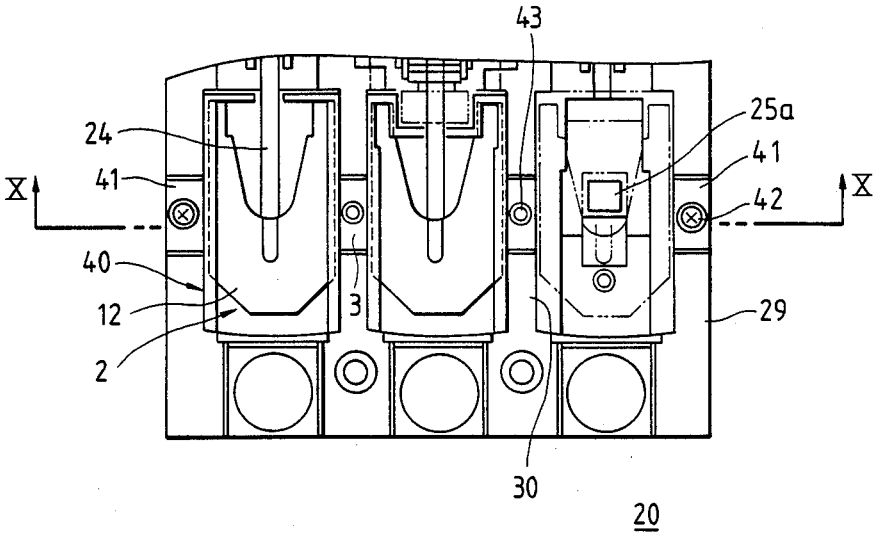
FIG. 9 is a principal plan view corresponding to FIG. 5, illustrating a state where the arc extinction chamber unit depicted in FIG. 8 is incorporated into the circuit breaker.
Figure 10:
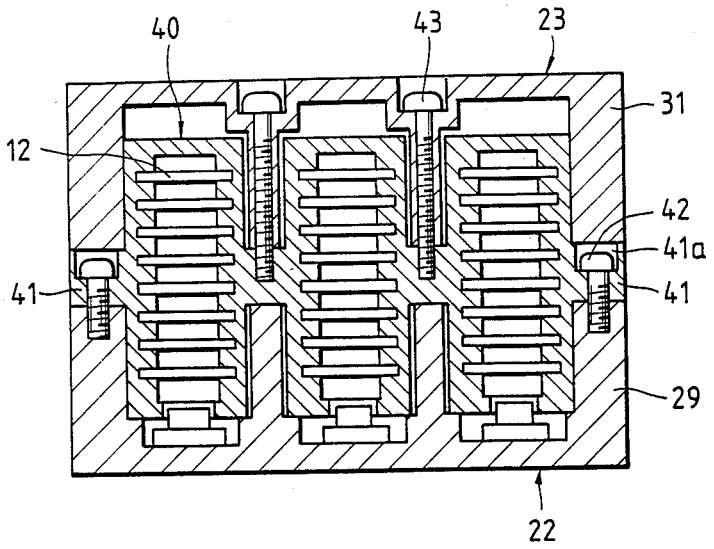
FIG. 10 is a sectional view taken substantially along the line X—X of FIG. 9.

A second embodiment of the present invention is shown in FIGS. 8, 9, and 10. FIG. 8 is a perspective view corresponding to FIG. 1. FIG. 9 is a principal plan view showing a state where the arc extinction chamber unit depicted in FIG. 8 is incorporated into the circuit breaker. FIG. 10 is a sectional view taken along the line X—X of FIG. 9. In these Figures, the same components depicted in FIGS. 1 through 7 are marked with the same symbols, and serve the same functions.

A major difference between the arc extinction chamber unit 40 of FIG. 8 and the arc extinction chamber unit 1 of FIG. 1 is that the restraining members 41 are fastened to the side walls 29 of the casing 22 with screws 42. In this case, the restraining member 41 assuming an angular bar-like configuration is fitted in the notch 29*a* of the side wall 29 of the casing 22 and is fastened to the side wall 29 with a screw 42 penetrating a spot facing hole 41*a*. This configuration results in greater retention of the gas pressure generated during the breaking. In accordance with the second embodiment, the cover is fastened to the coupling arms 3 of the arc extinction chamber unit 40 with screws 43 each penetrating the interposed partition wall 32.

Figure 11:
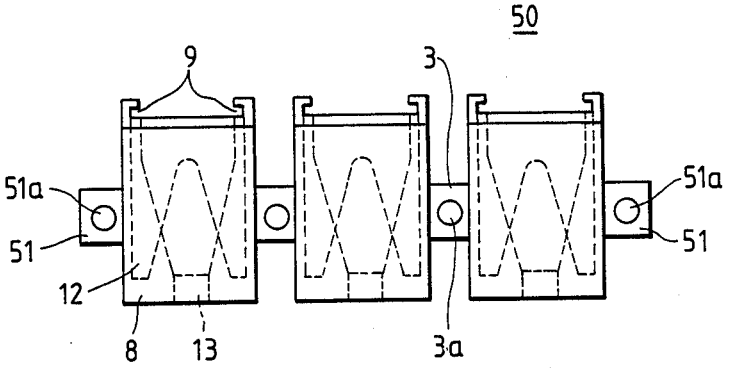
FIG. 11 is a plan view showing a third embodiment of the present invention.
Figure 12:
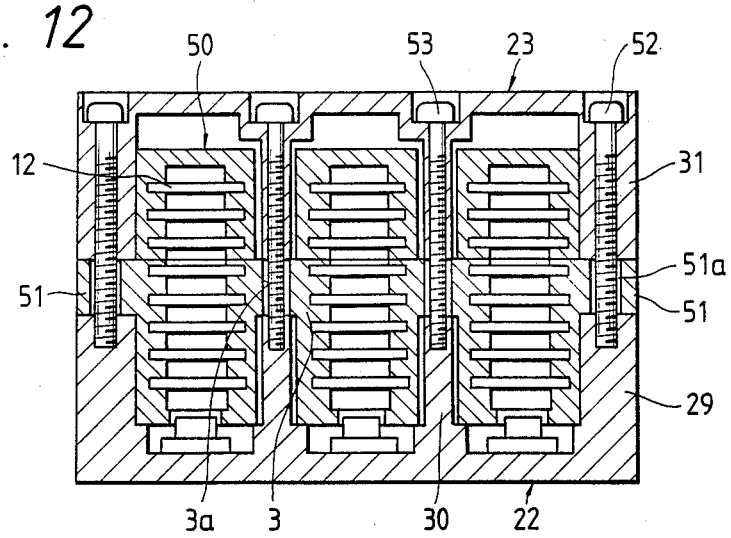
FIG. 12 is a sectional view corresponding to FIG. 10, illustrating a state where the arc extinction chamber unit depicted in FIG. 11 is incorporated into the circuit breaker.
Figure 13:
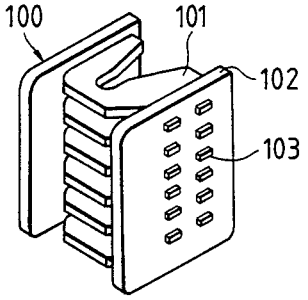
FIG. 13 is a perspective view showing a prior art device.
Figure 14:
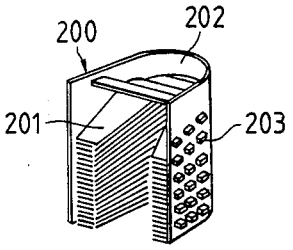
FIG. 14 is a perspective view showing another prior art device.
Figure 15:
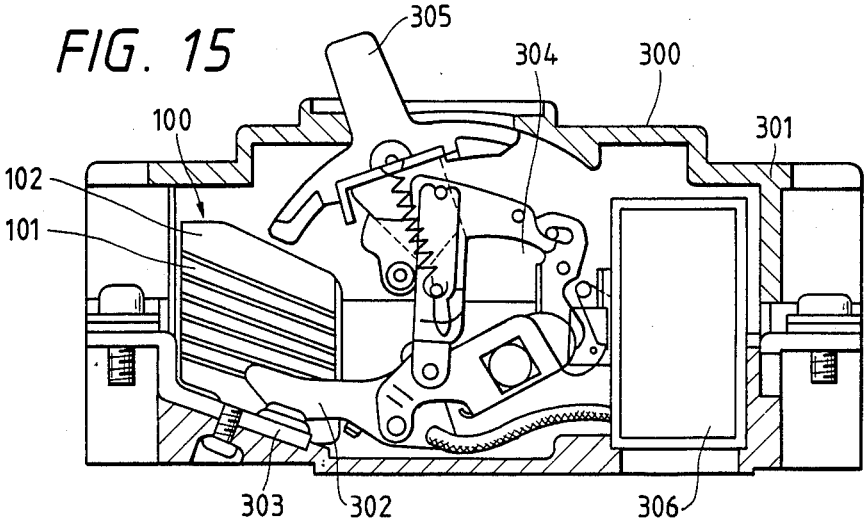
FIG. 15 is a vertical sectional view illustrating a circuit breaker into which the conventional device is incorporated.

FIGS. 11 and 12 in combination show a third embodiment of the present invention. FIG. 11 is a plan view of the third embodiment. FIG. 12 is a sectional view corresponding to FIG. 10, illustrating a state in which the arc extinction chamber unit is incorporated into the circuit breaker.

In this embodiment, the restraining members 51 are fastened together with the cover 23 to the casing 22 with the screws 52 passing through the side walls 31 of the cover 23. The coupling arms 3 are similarly fastened to the casing 22 with the screws 53 penetrating the interposed partition walls 32 of the cover 23. The symbols 51*a* and 3*a* designate holes through which the screws 52 and 53 are inserted.

As discussed above, the arc extinction chamber unit is composed of arc extinction chambers provided one chamber for each pole of the multipolar circuit breaker, and coupling arms for connecting these extinction chambers to each other. These chambers and coupling arms are molded into one integrated body. Hence, the present invention provides the following advantages.

(1) Based on the multipolar integral molded construction, it is possible to assemble the arc extinction chamber unit into the casing of the multipolar circuit breaker in a single step, considerably facilitating the assembly. Automatic assembly via use of robots is made significantly more efficient by the reduction of assembly steps.

(2) By virtue of the advantages of molding maleability, the arc extinction chamber can be shaped in a box-like configuration having extremely small openings. As a result, the arc extinction chamber is capable of containing the pressure of an arc gas generated during the breaking process, thereby reducing the pressure exerted on the outer box. Hence, the outer box need not be designed to withstand large internal pressures. Consequently, the entire assembly can be built smaller. This advantage reduces the quantity of materials needed, and less expensive materials may be used. The strength of the outer box can further be increased by using the restraining members provided at both ends of the arc extinction chamber unit to reinforce the outer box.

(3) The arc extinction chamber is based on a box-shaped construction, and the grids can be readily inserted in grooves in the inner walls. It is feasible to install the grids simply by fitting them in the grooves, thereby further facilitating the assembly process. Since the insulator walls of the arc extinction chamber are very strong, the falling-off of the grids associated with burning damage in the prior art can be eliminated.

(4) The deionization of the electric arc can be enhanced by properly selecting the resinous molding materials and internal geometry of the arc extinction chamber. More specifically, the inner wall surfaces of the arc extinction chamber are formed to assume a substantially V-shape, whereby the arc tends to stretch towards the grids and is easily held. Further, a good deal of deionizing gas can be evolved from the wall surfaces.

Although the illustrative embodiments of the present invention have been described in greater detail with reference to the accompanying drawings, it is to be understood that the invention is not limited to those precise embodiments. Various changes or modifications may be effected therein by one skilled in the art without departing from the scope or the spirit of the invention.

What is claimed is:

1. An arc extinction chamber unit for use in a multipolar circuit breaker, comprising:

a plurality of arc extinction chambers, one of said plurality of chambers being provided for each pole of the multipolar circuit breaker;

coupling arms connecting each of said plurality of arc extinction chambers to one another, said arc extinction chambers and coupling arms being molded into one unitary body.

2. The arc extinction chamber unit of claim 1, wherein the multipolar circuit breaker includes an outer box having opposing side walls, said unit further comprising restraining members disposed at opposite ends of said unit, each of said restraining members being connected to one of the opposing side walls of said outer box.

3. The arc extinction chamber unit of claim 1, wherein each of said arc extinction chambers is box-like in configuration.

4. The arc extinction chamber unit of claim 3 including a wall having an inner surface with a plurality of grooves and a grid inserted into each of said grooves.

5. The arc extinction chamber of claim 4, wherein said grids include aligned generally V-shaped indentations for confining an arc created in said multipolar circuit breaker.

* * * * *